United States Patent [19]

Wax

[11] 4,119,034

[45] Oct. 10, 1978

[54] LEAKPROOF INK SUPPLY RESERVOIR

[75] Inventor: Franz Wax, Munich, Germany

[73] Assignee: Siemens Aktiengesellschaft, Berlin & Munich, Germany

[21] Appl. No.: 874,205

[22] Filed: Feb. 1, 1978

[30] Foreign Application Priority Data

Feb. 4, 1977 [DE] Fed. Rep. of Germany ..... 2704735

[51] Int. Cl.[2] ..... B41F 31/02

[52] U.S. Cl. ..... 101/366; 346/140 R

[58] Field of Search ..... 101/1, 335, 364, 366; 346/140; 222/578, 95, 214

[56] References Cited

U.S. PATENT DOCUMENTS 3,482,258 12/1969 Steen ..... 101/366 X 3,708,798 1/1973 Hildenbrand et al. ..... 346/140

3,950,761 4/1976 Kashio ..... 346/40

FOREIGN PATENT DOCUMENTS 2,460,573 7/1976 Fed. Rep. of Germany ..... 346/140 R

*Primary Examiner*—J. Reed Fisher

*Attorney, Agent, or Firm*—Hill, Gross, Simpson, Van Santen, Steadman, Chiara & Simpson

[57] ABSTRACT

A replaceable ink reservoir for use in ink printing equipment, particularly mosaic jet ink printers equipped to receive replaceable reservoirs, the same reservoir including a housing containing a part flexible ink bag in a chamber defined by housing walls with a flexible membrane supported by the walls and plate means overlying the flexible membrane for application of pressure on the ink supplv to force the same through the printing head channels.

7 Claims, 3 Drawing Figures

LEAKPROOF INK SUPPLY RESERVOIR

BACKGROUND OF THE INVENTION

1. Field of the Invention

This invention relates to replaceable ink supplies for ink recording devices and particularly to that type of supply which includes a flexible ink container disposed in a housing which includes a means temporarily increasing the pressure on the ink supply.

2. Description of the Prior Art

In ink recording devices or printers, a common arrangement is to utilize a recording head which moves along a recording carrier such as a paper, the recording head being supplied with a recording fluid (ink) from a supply bottle by means of an ink supply system. The recording head may be a mosaic recording head in which a plurality of piezoelectrically operated ink jet nozzles are arranged. It has been known to supply the recording head with ink automatically due to the contractions which take place in the inking nozzles of the recording head upon actuation of the individual nozzles. Due to the physical principles involved in the supplying of ink to the nozzles, it is critically important that air be eliminated from the ink supply system. In order to eliminate such air, it has been proposed to provide means within the ink supply system which allow the pressure on the ink supply reservoir, or ink source, to be momentarily raised so as to surge ink through the ink supply channels and the jet nozzles in order that the channels and nozzles will be flushed with the ink forcing all air from the recording head. One known system incorporates a plunger supported on a spring element, which may be a bellow spring, in such a manner that the plunger can be pressed against a flexible ink container which is received in a tub shaped recess of an ink supply housing.

It is, however, possible in the known systems for the flexible container to suddenly spring a leak. Such leaks can occur either through a defective area of the flexible ink container or because of inadvertent perforation. In such an instance the ink contained can escape from the container into the tub shaped recess of the housing which receives the flexible ink container. If pressure is exerted on the plunger, the ink will be forced out of the recess, and, in the process, can soil the operator as well as the associated equipment.

It would therefore be an improvement in the art if an ink supply device could be provided which allows a momentary pressure increased to be imparted to the ink supply for ink flushing of the recorder head but which is constructed such that even if the flexible ink container is perforated that no ink will escape from the recess receiving the flexible container to the exterior of the device. Further, it would be advanced in the art to provide such a device which, even when pressure is being applied by an operator, will insure that the ink from a burst or perforated ink container will not be directed at the operator and will not soil surrounding areas of the equipment. Moreover, it would be a further advance in the art if such a device could be produced simply and economically.

SUMMARY OF THE INVENTION

The above advances in the art are provided according to this invention in that the housing of the exchangeable ink supply device forms a chamber for the flexible ink container and is provided with elevated side walls which define the ink container receipt chamber. The chamber is closed by an elastic diaphragm supported by the side walls. The diaphragm supports a plate means through which the operator can apply a momentary manual positive pressure on the ink supply. Further, the housing is provided with a combination venting and overflow channel connecting the flexible ink container chamber to a collection chamber which is equipped to store excess ink.

In one advantageous embodiment of the invention, illustrated herein, the elastic diaphragm is affixed to the supporting walls of the housing by means of a lid for the housing. The lid is equipped with a funnel-shaped opening in the center thereof through which the plate means can be contacted. The plate can then form a cup member having a bottom in contact with the elastic diaphragm and peripheral upstanding walls defining an open end in contact with the undersurface of the lid with the funnel-shaped lid opening projecting into the cup-shaped plate means such that the plate means closes the funnel-shaped opening of the lid.

A device constructed according to the principles of this invention will prevent any escape of ink which might otherwise result from a damage to the flexible ink container even when the ink pressure is manually momentarily raised. Moreover, because the ink containing area of the housing is closed from the operator, soiling of the operator is avoided. Moreover, by providing a combination ventilating and overflow channel to a collection chamber or reservoir, it is assured that ink escaping from the flexible ink container will not soil surrounding areas of the equipment. Moreover, the particular design of the preferred embodiment allows the plate means to cooperate with the lid and the elastic diaphragm to result in generation of an even load on the flexible ink container that when the plate means is manually depressed. The device, as a whole, is extraordinarily reliable and can be easily and economically produced. Because of the economical design employed, it is practical to provide such an ink supply device as an exchangeable, and even discardable, ink supply system for ink jet printer head assemblies.

Therefore, an object of this invention is to provide an improved ink supply for ink using apparatus.

Other objects, features and advantages of the invention will be readily apparent from the following description of a preferred embodiment thereof, taken in conjunction with the accompanying drawing, although variations and modifications may be effected without departing from the spirit and scope of the novel concepts of the disclosure, and in which:

DESCRIPTION OF THE PREFERRED EMBODIMENTS

Figure 1:
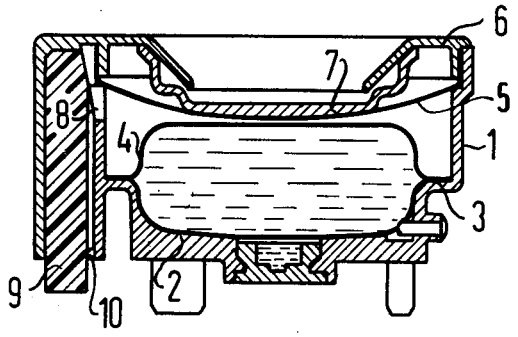
FIG. 1 is a cross-sectional view of an ink supply reservoir constructed according to this invention.
Figure 2:
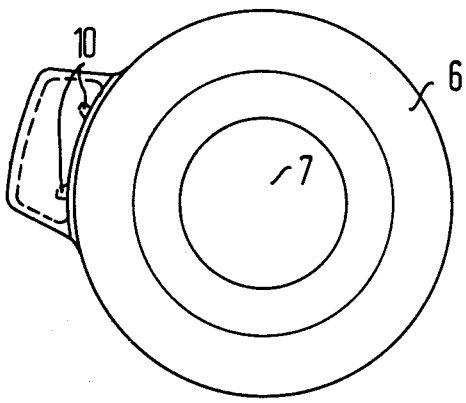
FIG. 2 is a top plan view of the ink supply reservoir of FIG. 1.

An ink supply device or reservoir constructed in accordance with this invention is illustrated in FIG. 1. The device includes a housing member 1 which may be formed of injection-molded plastic. The member 1 has a bottom, central, interior tub shaped recess 2. The tub shape recess 2 is covered by a flexible plastic film 4 fused at its edges 3. The tub recess 2 and film 4 are combined to form an ink container which is, at least in part, flexible. The ink container is filled with recording fluid or ink.

The housing, which in the shown embodiment, is substantially round, has an upstanding peripheral wall extending from the bottom wall in which the tub shaped recess is defined. The upstanding peripheral wall defines a chamber interior of the housing with the flexible ink container at least partially received in the chamber. The chamber is closed at its top by an elastic diaphragm 5. The diaphragm 5 is secured to the walls of the housing 1 by means of a lid 6 received thereon. The lid 6 has a central funnel shaped opening with the entrance walls of the funnel shaped opening extending downwardly and inwardly to an aperture through the lid. A plate means 7 is interpositioned between the undersurface of the lid and the top surface of the diaphragm 5 with the plate means being formed as a cup which opens upwardly towards the lid. The inner diameter of the cup shaped plate means 7 at the lid is such as to encompass the inwardly and downwardly extending wall of the funnel shaped opening. This maintains the plate means in a central position in the housing. Further, the elastic diaphragm 5 maintains the plate means against the undersurface of the lid. Moreover, the plate means 7 closes the funnel shaped opening.

By this construction, an even pressure can be exerted on the flexible ink container through the funnel shaped aperture such that the plate means 7 can be manually pressed against the flexible ink container.

The ink supply device is further provided with a collection chamber 9. The chamber may include a wick member, or other ink absorbing device, and may, as shown, be formed by an outwardly bulged portion of the lid which extends downwardly in parallel spaced relation to the peripheral wall of the housing. An overflow and venting channel 8 communicates the collection chamber 2 to the chamber interior of the housing which receives at least part of the flexible ink container.

With this construction, if, as a result of a defective part of the flexible ink container 4, ink escapes into the chamber formed interior of the housing 1, the ink will flow via the overflow and venting channel 8 to the collection chamber 9, which, being equipped with an absorbent pad, will retain the excess ink therein.

When the ink supply device is operated with the ink container 4 intact, projecting nibs 10 which project into the collection chamber 9 will properly space the absorbent pad insuring the creation of an air duct open to the overflow and venting channel 8. This provides a venting of the interior of the housing 1 as well as preventing blockage of the channel 8.

Figure 3:
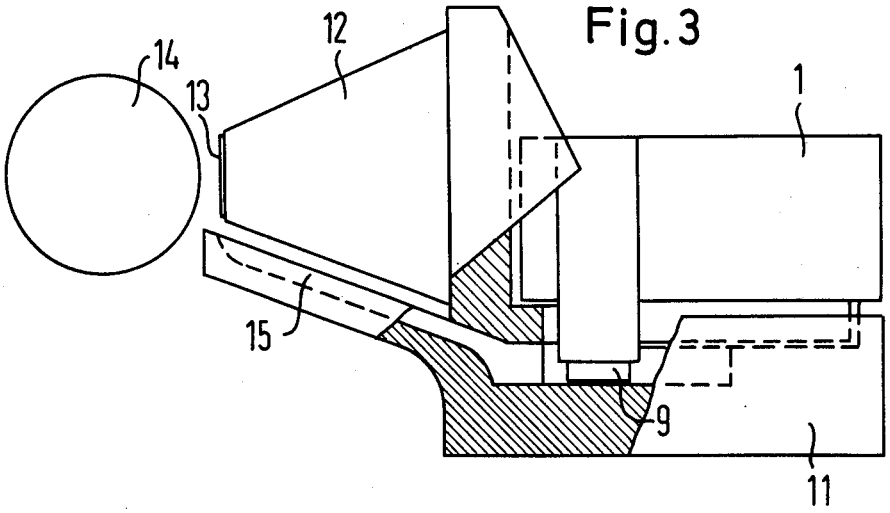
FIG. 3 is a schematic view, partially in section, of a recording head assembly equipped with the replaceable ink supply reservoir of this invention.

As diagrammatically illustrated in FIG. 3, the ink supply device is replaceably attached to a carriage 11 of an ink mosaic recorder. The flexible ink container of the ink supply device is there positioned below the outlet apertures of the recording head 12 such that a negative pressure is produced between the flexible ink container and the outlet apertures. By applying a positive pressure to the ink, as by depressing the plate means 7, the ink will flow from the flexible ink container through the channels of the recording head 12 and will exit the output apertures. A displaceable ink deflector 13, attached adjacent the operating face of the printing head, directs escaping ink to an ink return channel which in turn directs the ink back to the absorbent pad of the collection chamber 9. Moreover, the deflector 13 protects the platen 14 from soiling during this flushing process.

It will be appreciated that connection of the flexible ink container to the ink supply system of the recording head may be accomplished by standard methods such as piercing of a bottom seal of the replaceable ink supply device by a carriage 11 carried by a hollow needle.

Although the teachings of my invention have herein been discussed with reference to specific theories and embodiments, it is to be understood that these are by way of illustration only and that others may wish to utilize my invention in different designs or applications.

I claim:

1. In a replaceable ink supply device for use in supplying ink to an ink printing device with the supply device including a housing means containing at least part flexible ink container and means for temporarily increasing the pressure of the ink in the container, the improvement of the housing having elevated wall means defining a chamber in which the container is at least partially received, an elastic diaphragm closing the chamber in opposition to the ink container, a plate means carried by the diaphragm for applying pressure to the container by movement of the plate means, a collection chamber associated with the housing means for receipt of ink and a venting and over-flow channel between the chamber and the collection chamber interior.

2. Device according to claim 1 wherein the elastic diaphragm is affixed in the housing by means of a lid closing a top of the housing, the lid having an aperture therethrough with a funnel shaped entrance.

3. A device according to claim 2 wherein the plate means is cup shaped having an open top defined by peripheral walls, the open top being in engagement with an undersurface of the lid and being maintained in said engagement by the diaphragm, the plate means closing the lid aperture.

4. A device according to claim 1, wherein an absorbent pad is received in the collection chamber.

5. A device according to claim 4 wherein projecting spacing nibs extend into the collection chamber from a wall thereof engaging the absorbent pad and maintaining an air flow conduit through said collection chamber to said ventilating of an overflow channel.

6. Replaceable ink supply device comprising a housing having a bottom face and upstanding peripheral walls defining an interior chamber, at least part flexible ink container received in said chamber, an elastic diaphragm closing a top of said chamber, a movable plate means on an opposite side of said diaphragm from said chamber, the plate means movable against the resistance of the diaphragm to compress the flexible ink container, and a lid member for said device maintaining said movable plate in place in engagement with said diaphragm, the ink supply device being provided with an excess ink collection chamber and an overflow channel communicating the chamber to the excess ink collection chamber.

7. The device of claim 6 wherein the excess ink collection chamber is at least partially open to the surrounding atmosphere and means are provided communicating the surrounding atmosphere to the overflow chamber whereby the channel functions to vent the chamber.

* * * * *